United States Patent [19]

Iwaya et al.

[11] 4,389,811

[45] Jun. 28, 1983

[54] BIRD ACTION TOY

[75] Inventors: Hirokatsu Iwaya, Tokyo; Hiroshi Saigo, Kasukabe; Takashi Suzuki, Tokyo, all of Japan

[73] Assignee: Iwaya Kabushiki Kaisha, Tokyo, Japan

[21] Appl. No.: 321,462

[22] Filed: Nov. 16, 1981

[30] Foreign Application Priority Data

Nov. 19, 1980 [JP] Japan ..... 55-165661[U]

[51] Int. Cl.[3] ..... A63H 33/26; A63H 11/00

[52] U.S. Cl. ..... 46/232; 46/265; 46/124; 46/118; 46/32

[58] Field of Search ..... 46/264, 265, 123, 124, 46/32, 232, 118, 120, 126

[56] References Cited

U.S. PATENT DOCUMENTS 1,319,581 10/1919 Hawkins ..... 46/124 X
2,294,241 8/1942 Rober ..... 46/124 X
2,953,869 9/1960 Collischan ..... 46/124 X
3,008,267 11/1961 Schneider ..... 46/124
3,060,631 10/1962 Collischan ..... 46/124 X

FOREIGN PATENT DOCUMENTS 477825 6/1929 Fed. Rep. of Germany ..... 46/124

*Primary Examiner*—Mickey Yu
*Attorney, Agent, or Firm*—James E. Nilles

[57] ABSTRACT

A bird action toy in which a bird toy body capable of inclining forward and returning to the upright position on a perch and of performing such actions simultaneously as opening and closing its bill, producing chirping sounds and swinging its tail is detachably fitted over the supporting member through an adapter. The bird toy body comprises cam and a motor for driving the cam, the cam being engaged with the engagement rod projecting from the perch so as to incline the body forwardly and return it to the upright position. The perch serves as a case for storing batteries to drive the motor installed in the toy body.

11 Claims, 8 Drawing Figures

BIRD ACTION TOY

BACKGROUND OF THE INVENTION

1. Field of the Invention

This invention relates to a bird action toy.

2. Description of the Prior Art

Various kinds of bird action toys have already been proposed which imitate the action of actual birds. Most of the conventional toys, however, are limited to those kinds which perform bird actions on the floor or are intended to be played with by hand. That is, many of the conventional bird action toys are designed solely for playability or the capability to provide amusement when played with by hand.

SUMMARY OF THE INVENTION

An object of this invention is to provide a bird action toy which can be detachably mounted onto a desired supporting member to retain the playability with hand.

Another object of the invention is to provide a bird action toy which can be used as a decoration that performs interesting actions and enhances the beauty of supporting member on which the toy is mounted, or of the room where the supporting member is placed.

To achieve the above objective, the bird toy of this invention comprises: a perch; a bird toy body being modeled after an actual bird, the bird toy body capable of inclining forward and returning to the upright position on the perch and of performing such actions simultaneously as opening and closing its bill, producing chirping sounds and swinging its tail; and an adapter consisting of a receiver into which the perch can detachably be fitted and a mount which can be detachably fitted over the supporting member.

These and other objects and features of this invention will become apparent from the following descriptions taken in conjunction with the accompanying drawings.

DESCRIPTION OF THE PREFERRED EMBODIMENTS

Figure 1:
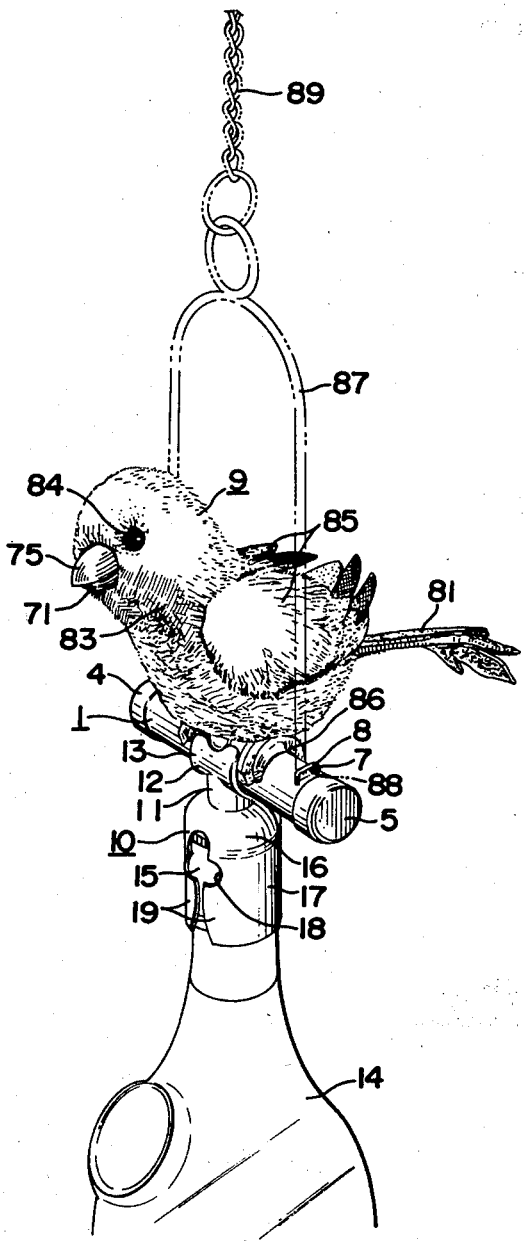
FIG. 1 is a perspective view of a bird toy mounted on the stay.

Referring to the above drawings, designated 1 is a perch of synthetic resin which is a hollow cylinder with one end closed, serving as a battery storage case 4 containing batteries 3 in its hollow portion 2. A cover 5 with a switch is detachably and rotatably attached to the other open end of the battery case 4. A hollow cylindrical stay 6 is erected integrally at the middle portion of the battery case 4. The battery case 4 has near its ends two projecting engagement pieces 8 formed integral therewith, with a hole 7 cut in each of the engagement pieces 8.

Denoted 9 is a bird toy shaped after a bird which is constructed so that it performs actions similar to those of actual birds, as described later. The bird toy 9 is mounted on the stay 6 projecting from the middle portion of the perch 1.

An adapter 10 formed of synthetic resin has a cylindrical base 11 and a receiver 12 above the base 11, both being formed integral with each other. The perch 1 can be put into and taken out of the receiver 12. The receiver 12 is formed semicircular in cross section, consisting of curved holders 13 which resiliently hold the perch 1 from both sides. Also formed integral with and under the base 11 is a mount 16 that is adapted to be detachably fitted over the mouth 15 of the bottle 14. The mount 16 is formed cylindrical with an open lower end and has pair of notches 18 cut in the opposite sides of the cylindrical portion 17, extending from the lower edge to the upper portion thereof. The notches 18 divides the cylindrical portion 17 into a pair of curved holding pieces 19 facing each other which resiliently holds the mouth 15 of the bottle 14 therebetween from the sides.

The bird toy 9 has a body 20 shaped similar to that of the actual bird body, which contains a gear train frame 21. The lower end of the gear train frame 21 is rotatably mounted on the base shaft 22 rigidly secured to and horizontally passing through the upper portion of the stay 6. The base shaft 22 has a pair of vertically extending pieces 23 formed integral with each end thereof, to which both ends of the transverse shaft 24 that passes horizontally through the intermediate portion of the stay 6 are secured. The base shaft 22 has a spacer 25 at each end. Secured to one end of the base shaft 22 is a support arm 26 which is inclined forwardly upward with an engagement rod 27 projecting from the inner side of the top end of the arm 26. Secured to the other end of the base shaft 22 is another support arm 28 which inclines forwardly upward at a greater angle than that of the arm 26. The support arm 28 has an engagement rod 29 projecting from the inner side of its free end. The engagement rod 29 is adapted to engage with the stopper 30 projecting from the front end on one side of the frame 21 so as to prevent the toy 9 from falling down rearwardly.

A motor 31 is mounted in the front end portion of the frame 21 and is electrically connected to the battery 3 contained in the battery case 4 of the perch 1. The motor 31 is turned on and off by the switch which in turn is closed and opened by rotating the cover 5.

Figures 4, 6, 7, 8:
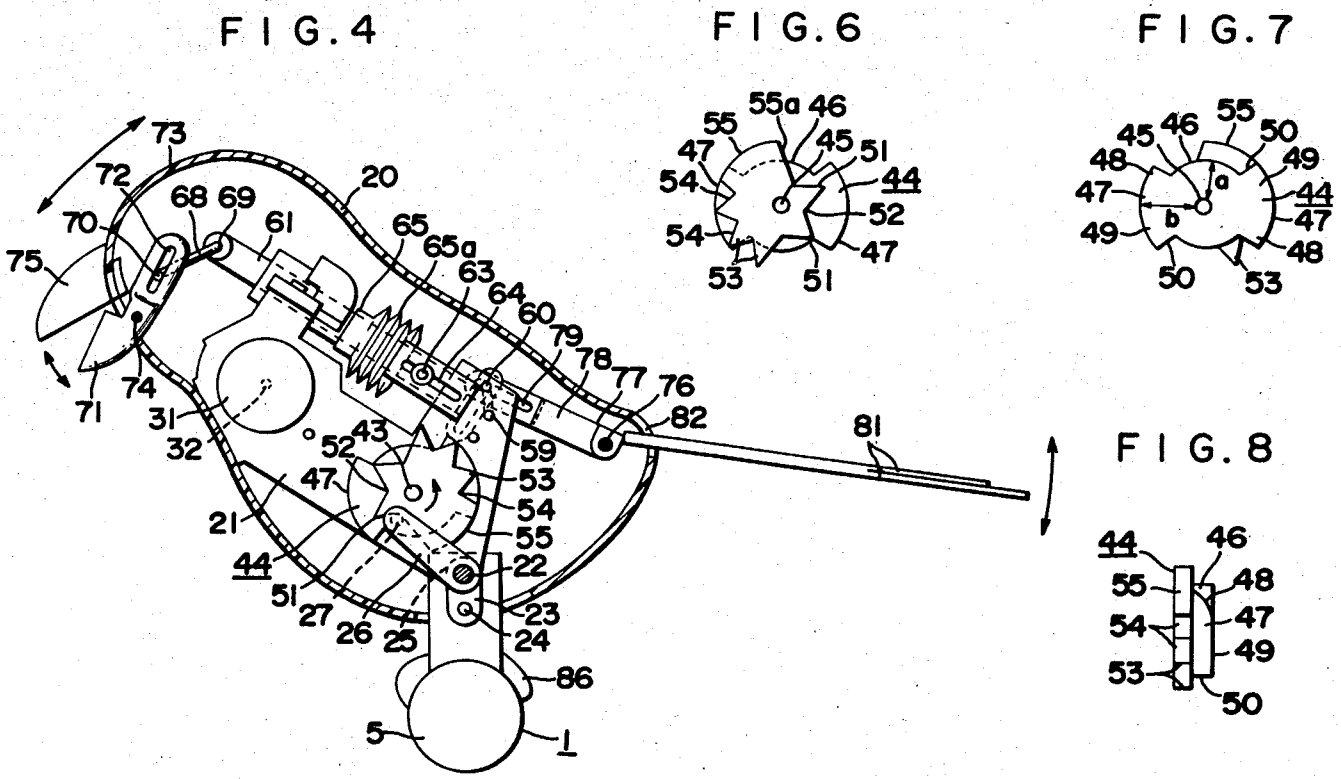
FIG. 4 is a cross-sectional view of the toy as illustrated in FIG. 2, showing its action.
FIG. 6 is a front view of the cam.
FIG. 7 is a rear view of the cam.
FIG. 8 is a side view of the cam.
Figure 5:
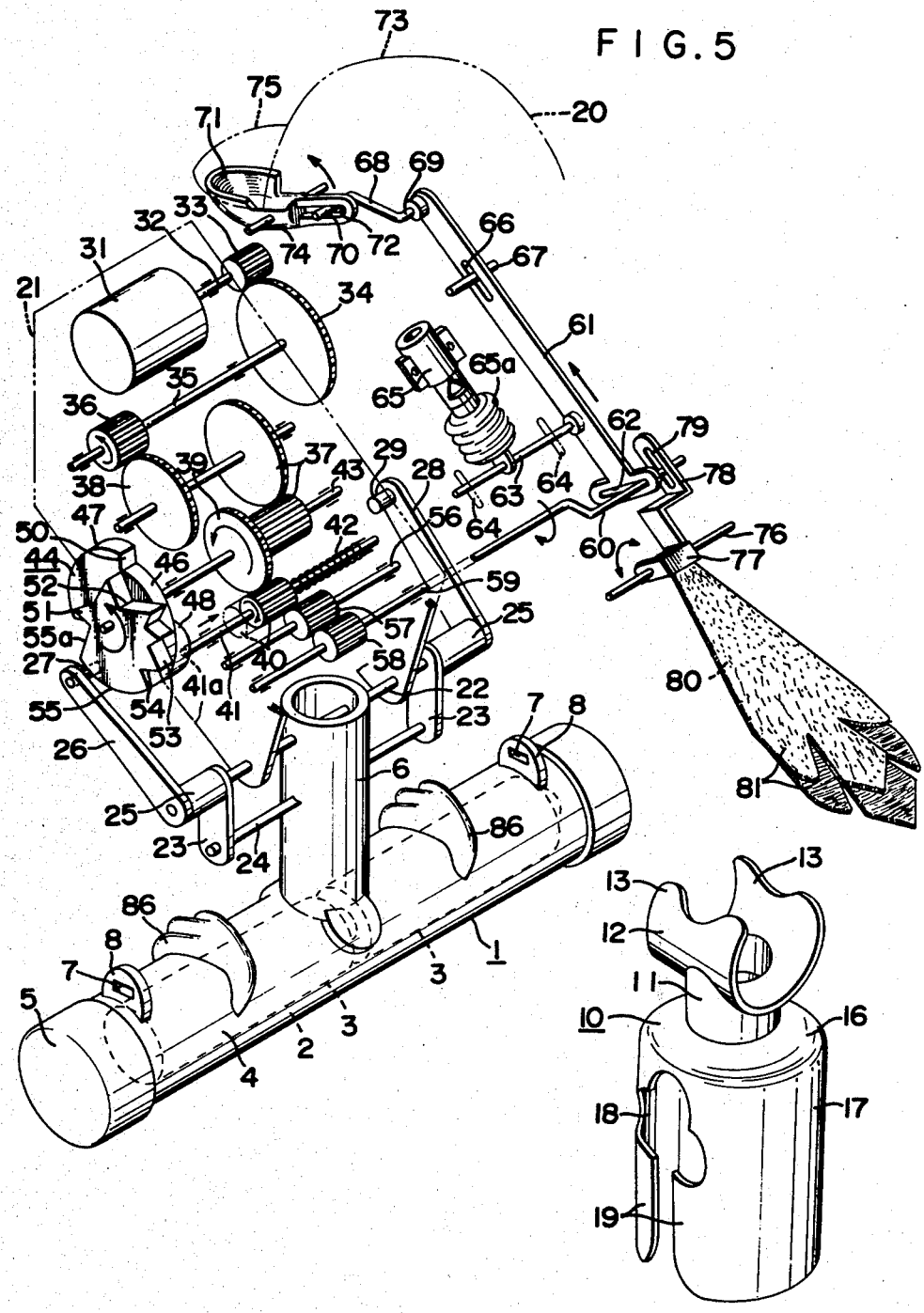
FIG. 5 is a perspective view of the mechanism of the toy shown dissassembled.

The output shaft 32 of the motor 31 has a pinion 33 securely mounted thereon which engages with a reduction gear 34 at one end is rotatably supported by the frame 21 and has a pinion 36 securely mounted on the other end thereof. The pinion 36 engages with the transmission gear 38 of the gear transmission mechanism 37. The gear transmission mechanism 37 has a relay gear 39 engaged with an on-off gear 40 which can be slid relative to the relay gear 39. The slide shaft 41 to which the on-off gear 40 is securely mounted is slidably supported by the frame 21, and has a coil spring 42 fitted thereover between the on-off gear 40 and one side of the frame 21 to urge the on-off gear 40 and the shaft 41 toward the other side of the frame. The drive shaft 43 on which the relay gear 39 is securely mounted is rotatably supported by the frame 21 and has a disc shaped cam 44 secured to one end thereof. As shown in FIGS. 6 through 8, the cam 44 has a hole 45 at the center through which to insert the drive shaft 43. The cam 44 consists of two components. One of them, which is on the inner side when assembled as shown, has a peripheral surface 46 and a pair of opposing raised engagement edges 47. The peripheral surface 46 has a radius a from the center hole 45 and the engagement edges 47 raised from the peripheral surface 46 has the radius b which is greater than a. The inner side component of the cam 44 has an inclined guide surface 48 inclining from the outer edge to the inner, formed at the connection between the front end, with respect to the direction of rotation, of the engagement edges 47 and the peripheral surface 46. The inclined guide surfaces 48 are to guide the engagement portion 41*a* formed at the outer end of the slide shaft 41. The raised edges 47 have on its inner periphery a push surface 49 which, when engaged with the outer engagement portion 41*a* of the slide shaft 41, pushes it against the force of the coil spring 42. A step 50 is formed at the connection between the periphery surface 46 and the rear end, with respect to the direction of rotation, of the engagement edges 47. The other component of the cam 44, which is on the outer side when assembled as shown, has a plurality of teeth made up of pointed projections 51 and depressions 52 alternately arranged at one portion of the periphery. At another part of the periphery, the outer side component has a plurality of pointed projections 53 and depressions 54 alternately arranged with the top ends of the projections 53 extending further outwardly than those of the first projections 51. The outer side component also has a sector engagement surface 55 of a certain width extending from the rear end of the projections 53 with respect to the direction of rotation. The projections 51 and depressions 52, the larger diameter projections 53 and the depressions 54, and the engagement surface 55, as they rotate, successively engage with the engagement rod 27 projected from the inner side of the support arm 26 at the front end to cause the bird toy 9 to lower and raise its head.

A shaft 56 supported on the rear upper portion of the frame 21 has a gear 57 secured thereto, with which the on-off gear 40 can be brought into or out of engagement. A follower gear 58 always in mesh with the gear 57 is securely mounted to the crankshaft 59 which in turn is rotatably supported by the frame 21. The crank arm 60 formed at one end of the crankshaft 59 is rotatably inserted through the vertically elongate guide slits 62 formed in the rear end of the action arm 61. An action rod 63 projecting perpendicularly from the inner side of the rear portion of the action arm 61 is inserted through the longitudinal guide slits 64 in the frame 21 so that the action rod 63 can be moved back and forth in the slits 64. Attached to the action rod 63 is a flexible bellow 65*a* of the whistle 65. The whistle 65 is secured to the frame 21 and made to produce a chirping sound as the action arm 61 moves back and forth through the action rod 63. A support rod 67 projecting from the frame 21 is inserted through the guide slit 66 formed in the front portion of the action arm 61. The action arm 61 has secured to its front end a crank arm 69 formed at one end of the crankshaft 68. Another crank arm 70 formed at the other end of the crankshaft 68 is rotatably inserted through the guide slit 72 of the lower bill 71, which is formed like a bird's bill. The lower bill 71 is pivotally supported on the lateral shaft 74 mounted in the face portion of the head 73, The head 73 is integrally formed with the body 20. The lower bill 71 is projected forwardly from an opening 73*a*. An upper bill 75 formed in the likeness of the actual bird bill is placed above the lower bill 71 and projected from the face portion of the head 73.

Horizontally supported in the rear end portion of the body 20 is a shaft 76 on which a rotating piece 77 is rotatably mounted. The rotating piece 77 has a forwardly projecting plate 78 which has a longitudinal guide shaft 79 into which the crank arm 60 of the crankshaft 59 is rotatably inserted. The rotating piece 77 has a rearwardly projecting piece 80 to which is secured a tail 81 modeled after actual bird tail which is extended reearwardly from the opening 82 formed at the rear end portion of the body 20.

A covering member 83 having feather to imitate the actual bird feather is fitted over the body 20 and the head 73. The covering member 83 is fitted with the imitation of bird's eyes 84 and wings 85. A pair of legs 86 provided just under the lower portion of the covering member 83 on each side are secured to the perch 1.

Now, we will explain the action of this toy. In placing the bird toy on the top of the bottle, the following steps should be taken. As the central portion of the perch on which the bird toy 9 is mounted is pressed into the receiver 12 formed on the top of the adapter 10, the holding pieces 13 on both sides of the receiver 12 are pushed open outwardly against their elastic force. When the perch 1 is completely fitted into the receiver 12 the holding pieces 13 snap back to their normal position holding the perch 1 therebetween. In this way, the adapter 10 can easily be attached to the perch.

Next, as the mount formed under the adapter 10 fitted to the perch 1 is pushed onto the mouth 15 of the bottle 14 as a support member, the mouth 15 of the bottle opens the holding pieces 19 of the mount 16 outwardly against their elastic force until the mouth 15 is completely inserted into the mount 16 with the holding pieces 19 holding it therebetween. In this way the mount 16 can easily be mounted on the mouth 15 of the bottle 14 with a single action.

With the above steps taken, the toy bird 9 resting on the perch 1 has been mounted on the mouth 15 of the bottle 14 through the adapter 10.

When suspending the toy 9, the mount 16 can easily be pulled out from the mouth 15 of the bottle 14 and the perch 1 from the receiver 12 by pulling the adapter 10.

Then, after the adapter 10 has been removed, a hook 88 at each end of the suspending member 87 is hooked to the hole 7 of the engagement piece 8 formed at each end of the perch. And the upper end of the chain 89 attached to the upper portion of the suspending member 87 is secured to a desired location. In this way, the toy bird 9 sitting on the perch 1 can easily be suspended from anything.

The bird toy 9 therefore can either be placed on the top of the bottle 14 as if it were sitting on it or be suspended as if it were playing with a swing.

In the above construction, when the cover 5 on the battery storage case 4 is rotated, the motor 31 electrically connected to the battery 3 in the case 4 is turned on. This drives the pinion 33 on the output shaft 32 of the motor 31, which in turn rotates the reduction gear 34, the pinion 36, the gear 38, gear transmission mechanism 37, and the relay gear 39 of this mechanism 37, all these meshed with each other in this series. The rotation of the relay gear 39 drives the cam 44 mounted on one end of the same drive shaft 43 of the relay gear 39.

Figure 3:
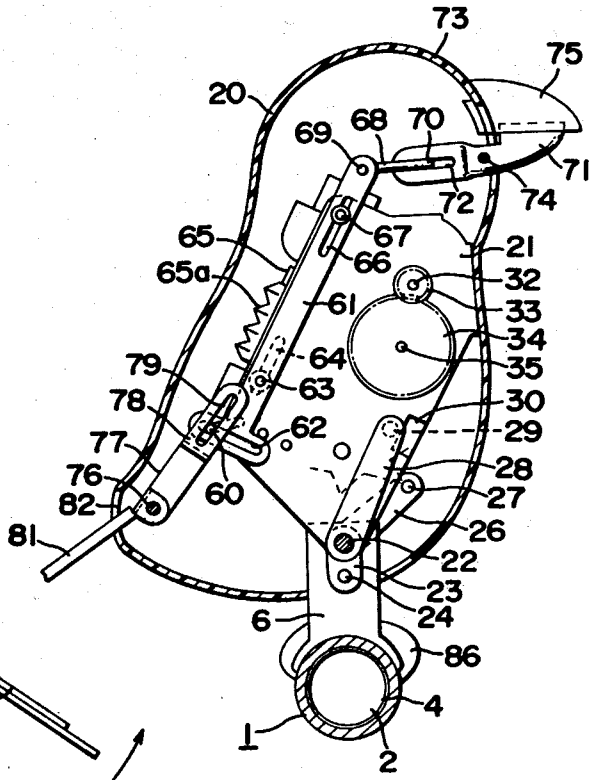
FIG. 3 is a cross-sectional view of the toy as viewed from the other side.
Figure 2:
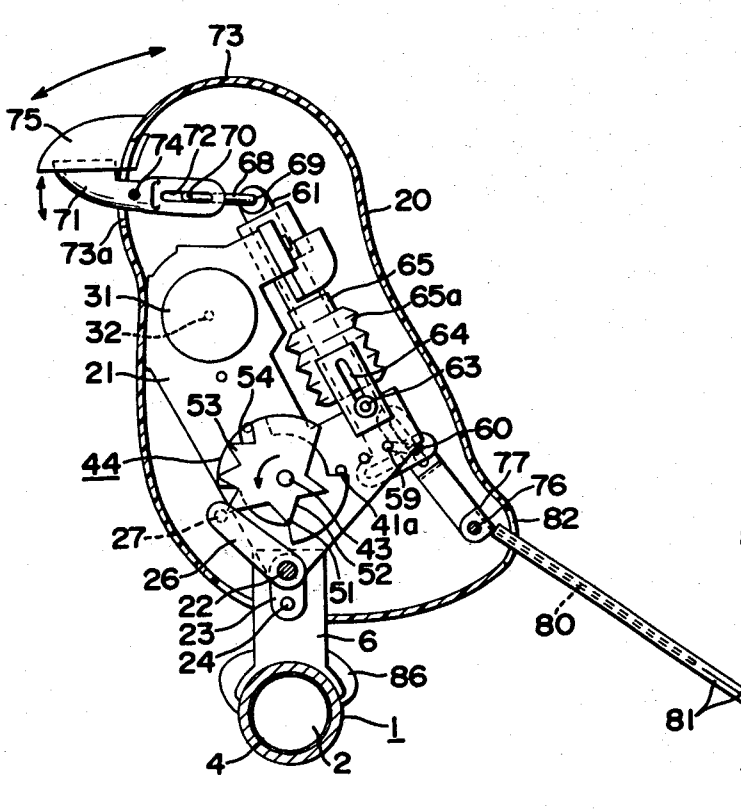
FIG. 2 is a cross-sectional view of the toy as viewed from one side.

As shown in FIGS. 2 and 3, as the cam 44 rotates, the first projection 53, with respect to the direction of rotation, of the larger diameter teeth following the depression 52 of the smaller diameter teeth formed on the outer component of the cam 44 engages with the rod 27 of the support arm 26. This causes the toy bird 9 to rotate clockwise around the base shaft 22, sending it from the forwardly inclined position to the raised position. At the same time, the outer engagement portion 41*a* of the slide shaft 41 positioned at the peripheral surface 46 of the inner component of the cam 44 engages with the inclined guide surface 48 of one of the opposing raised edges 47, which begins to push the slide shaft 41 against the coil spring 42. This causes the on-off gear 40 mounted on this slide shaft 41 and being rotated by the relay gear 39 to come into engagement with the gear 57. The rotation of the gear 57 in turn drives the follower gear 58 mounted on the crankshaft 59.

As the cam 44 continues to rotate, the rod 27 of the support arm 26 is brought into engagement with the succeeding projections 53 and depressions 54 alternately of the larger diameter teeth, oscillating the toy bird 9 forward and backward around the base shaft 22.

At the same time, with the cam 44 rotating, the outer engagement portion 41*a* of the slide shaft 41 is guided along the inclined guide surface 48 to the push surface 49 of the raised edge 47. As the outer engagement portion 41*a* engages with the push surface 49, the on-off gear 40 on the slide shaft 41 is further pushed against the force of the coil spring 42 into a complete meshing with the gear 57, thereby transmitting the output of the relay gear 39 to the gear 57 and therefore the follower gear 58 in mesh with the gear 57.

The rotation of the follower gear 58 drives the crankshaft 59 on which the follower gear 58 is securely mounted, and also the crank arm 60. This in turn drives the action arm 61 and the rotating piece 77 simultaneously, both being linked to the crank arm 60 through the guide slits 62 and 79 respectively. The action arm 61 has its front portion supported longitudinally movable by the support rod 67 so that it can be oscillated back and forth as the crank arm 60 rotates. The longitudinally movable action rod 63 projecting from the rear portion of the action arm 61 expands or contracts the bellow 65*a* of the whistle 65 to produce a chirping sound as the action arm moves back and forth. The action arm 61 has secured to its front end the crank arm 69 of the crankshaft 68 in such a manner that the crankshaft 68 is forwardly inclined downward with respect to the action arm 61. As the action arm 61 oscillates back and forth, the lower bill 71 linked through the guide slit 72 to the crank arm 70 of the crankshaft 68 is pivoted about the lateral shaft 74, so that the bird toy 9 chirps as it opens its bill.

The rotating piece 77 at the rear of the body is pivoted up and down about the support shaft 76, oscillating the projection 80 and the tail 81 which is secured to the projection and modeled after the bird's tail.

Thus, the toy bird 9 sitting on the perch 1 performs several actions simultaneously, i.e., swinging its tail 81, opening and closing its bill and chirping.

As the cam 44 is further rotated, the engagement rod 27 of the support arm 26 engages with the sector engagement surface 55 of large diameter following the last depression 54, with respect to the direction of rotation, of the cam 44. When the sector engagement surface 55 slides on the engagement rod 27, the toy bird 9 stops oscillating its body and at the same time the outer engagement portion 41*a* of the slide shaft 41 comes off the push surface 49 on the raised edge 47 of the inner component of the cam 44, allowing the slide shaft 41 to be pushed toward the cam 44 by the force of the coil spring 42. The outer engagement portion 41*a* of the slide shaft 41 then moves past the step 50 at the rear end of the raised edge 47 and rests on the peripheral surface 46. This brings the on-off gear 40 on the slide shaft 41 out of mesh with the gear 57, stopping the rotation of the crankshaft 59, with the result that the opening action of the bill by the arm 61, the chirping sound of the whistle 65 and the oscillation of the tail 81 by the rotating piece 77 all come to halt.

As the cam 44 further rotates and the rod 27 of the support arm 26 engages with the depression 52 of the small diameter teeth following the engagement surface 55 and the step 55*a*, the toy bird 9 is rotated counterclockwise about the base shaft 22 to a predetermined angle so that the bird is inclined forwardly from the upright position.

At this time, the outer engagement portion 41*a* resting on the peripheral surface 46 of the inner component of the cam 44 begins to be guided along the inclined guide surface 48 of the raised edge 47 which, during the sliding engagement with the outer engagement portion 41*a*, moves the slide shaft 41 away from the cam 44 against the force of the coil spring 42. As a rsult, the on-off gear 40 on the slide shaft 41 rotating in mesh with the relay gear 39 comes into mesh with the gear 57. The rotation of the gear 57 drives the follower gear 58 of the crankshaft 59.

As the cam 44 continues to rotate further, the projections 51 and depressions 52 of small diameter teeth of the cam 44 engage alternately with the rod 27 of the support arm 26, thus oscillating the toy bird 9 back and forth around the base shaft 22 with the bird 9 inclined forwardly.

When the outer engagement portion 41*a* of the slide shaft 41 shifts its relative position from the inclined guide surface 48 to the push surface 49 of the raised edge 47, it is further pushed by the push surface 49 against the spring 42 to bring the on-off gear 40 into a complete mesh with the gear 57, which transmits the output of the relay gear through the on-off gear 40 to the follower gear 58.

The follower gear 58 then rotates the crankshaft 59, which in turn drives the action arm 61 and the rotating piece 77, both being linked to the crank arm 60 of the crankshaft 59 through the guide slits 62 and 61, respectively. The action arm 61 has its front portion supported longitudinally slidable by the support rod 67 so that it can be oscillated back and forth as the crank arm 60 rotates. The action rod 63 projected from the rear portion of the action arm 61 causes the bellow 65 of the whistle 54 to expand and contract producing chirping sounds. The action arm 61 also has secured to its front end portion the crank arm 69 of the crankshaft 68 in such a manner that the crankshaft 68 is forwardly inclined downward with respect to the action arm 61. As the action arm 61 is oscillated back and forth, the lower bill 71 which is linked to the crank arm 70 of the crankshaft 68 through the guide slit 72 is pivoted up and down about the lateral shaft 74. The toy bird 9, therefore, chirps as it opens and closes its bill.

The rotating piece 77 at the rear end of body is also oscillated up and down about the shaft 76. This in turn oscillates the projection 80 protruding from the rotating piece 77 and the tail 81 secured to the projection 80.

Thus, as shown in FIG. 4, the toy bird 9 sitting on the perch 1 in its forwardly inclined posture swings its tail 81 while opening and closing its bill and producing chirping sounds.

As the cam 44 is further rotated and the projections 53 of larger diameter teeth following the last depression 52 of the small diameter teeth engage again with the rod 27 of the support arm 26, the toy bird 9 is rotated clockwise about the base shaft 22 from the forwardly inclined position to the upright position. In this position, the toy bird 9 sitting on the perch 1 repeatedly whisks its tail 81 while opening and closing its bill and producing chirping sounds.

Although in this embodiment the bottle 14 is taken as an example of a supporting member, it may be other member as long as it can engage with the mount of the adapter 10.

According to this invention, a toy bird is obtained which can be forwardly inclined or raised to the upright position on the perch and which swings its tail and chirps while opening and closing its bill. The toy bird of this invention also has the following features. The receiver of the adapter is so formed that the perch on which the toy bird is mounted can be fitted into it; and the mount of the adapter can easily be fitted over or removed form a desired supporting member such as bottles. This enables the bird toy to appear as if it came flying down and sat on the top of the bottle and at the same time to serve as a good decoration to the supporting member as well as the room in which the supporting member is installed. By making it to perform the aforementioned actions, the toy bird as well as the supporting member can be made more interesting, giving unique atmosphere to the room where the supporting member is installed. Since the adapter can easily be removed from the perch, the toy bird itself can be played with by hand, providing a variety of ways of enjoying the toy. Furthermore, it can also be used as a decoration.

What we claim is:

1. An animal action toy comprising:

a hollow perch;

means on said perch for detachably supporting said perch on another object;

a battery receptacle in said hollow perch for receiving a battery therein;

an electric switch on said perch for connecting and disconnecting a battery in said receptacle;

model support means on and extending upwardly from said perch;

a model animal including a main hollow body portion and at least one subsidiary body portion relatively movable with respect to said main hollow body portion, said main hollow body portion including an aperture through which said model support means extends;

an operating mechanism located within said main hollow body portion of said model animal and mechanically connected to said model support means on said perch, to said main hollow body portion and to said subsidiary body portion;

and an electric motor located within said main hollow body portion of said model animal, said motor being mechanically connected to drive said operating mechanism and operable when electrically energized to effect relative motion between said main hollow body portion and said perch and between said subsidiary body portion and said main hollow body portion, said motor being electrically connectable to and disconnectable from said battery receptacle by means of said electric switch.

2. A toy according to claim 1 wherein said hollow perch is generally tubular in shape, wherein said battery receptacle is accessible through an opening in an end of said perch, and wherein said electric switch is mounted on an end of said perch.

3. A toy according to claim 1 or 2 wherein said model support means includes a passage communicating between said battery receptacle and the hollow interior in said main body portion.

4. A toy according to claim 1 or 2 wherein said means on said perch for supporting said perch on another object comprises means whereby said perch may be suspended from another object above said perch.

5. A toy according to claim 4 wherein said means on said perch further comprises a detachable adapter which is connectable to another object below said perch.

6. A toy according to claim 5 wherein said adapter comprises a receiver into which said perch can be detachably fitted and a mount which can be detachably fitted over said object below said perch.

7. A toy according to claim 1 or 2 wherein said operating mechanism comprises:

a gear train frame which is pivotably mounted on said model support means and connected to said main body portion, said electric motor being mounted on said gear train frame, a cam rotatably mounted on said gear train frame and rotatably drivable by said electric motor, and cam engaging means stationarily mounted on said model support means and engaged with said cam as the cam rotates to effect rocking motion of said main body portion and said perch between upright and inclined positions.

8. A toy according to claim 7 wherein said operating mechanism further comprises a crankshaft rotatably mounted on said gear train frame and connected to be rotatably driven by said electric motor, said crankshaft having a crank arm formed thereon;

and an action arm movably mounted on said gear train frame and connected to drive said subsidiary body portion and connected to be moved by said crank arm whereby said subsidiary body portion moves reciprocably relative to said main body portion.

9. A toy according to claim 8 wherein said model animal comprises two of said movable subsidiary body portions, including a movable mouth portion and a movable tail portion, wherein both of said subsidiary body portions are connected to be driven by said action arm.

10. A toy according to claim 9 further including a noise-making device operable to simulate the noise made by an animal and located within said main hollow body portion and supported on said gear train frame, said noise-making device having a movable portion actuatable to produce said noise connected to be actuated by said action arm.

11. A toy according to claim 10 wherein said model animal takes the form of a bird and wherein said noise-making device comprises a whistle and bellows for sounding said whistle to produce a chirping sound simulating the noise made by a bird.

* * * * *